United States Patent [19]

Sutter et al.

[11] Patent Number: 4,568,440

[45] Date of Patent: Feb. 4, 1986

[54] BIPOLAR ELECTROLYZER HAVING FIXEDLY SPACED APART ELECTRODES

[75] Inventors: Robert C. Sutter, Painesville; Russell M. Wiseman, Mentor, both of Ohio

[73] Assignee: Eltech Systems Corporation, Boca Raton, Fla.

[21] Appl. No.: 527,690

[22] Filed: Aug. 30, 1983

[51] Int. Cl.[4] ..... C25B 9/00; C25B 11/00; C25B 13/00

[52] U.S. Cl. ..... 204/268; 204/269; 204/279; 204/286

[58] Field of Search ..... 204/268, 269, 270, 279, 204/286, 290 G

[56] References Cited

U.S. PATENT DOCUMENTS

| | | | |
|---|---|---|---|
| 2,799,643 | 7/1957 | Raetzsch | 204/270 |
| 3,410,784 | 11/1968 | Maunsell et al. | 204/268 |
| 3,759,815 | 9/1973 | Larsson | 204/290 G |
| 3,819,503 | 6/1974 | Casson et al. | 204/268 |

*Primary Examiner*—Donald R. Valentine
*Attorney, Agent, or Firm*—Arthur S. Collins

[57] ABSTRACT

A bipolar electrolyzer is provided which includes a plurality of bipolar electrode sub-assemblies which position the electrodes in the cells in a manner such that improved electrical operating characteristics are achieved. Each bipolar electrode sub-assembly includes an alternating stack of electrically insulating spacer members and bipolar electrodes. Electrodes are horizontally received in a channel in the electrically insulating spacer members which fixes the spaced relationship between juxtapositioned anodes and cathodes.

3 Claims, 5 Drawing Figures

FIG. 2
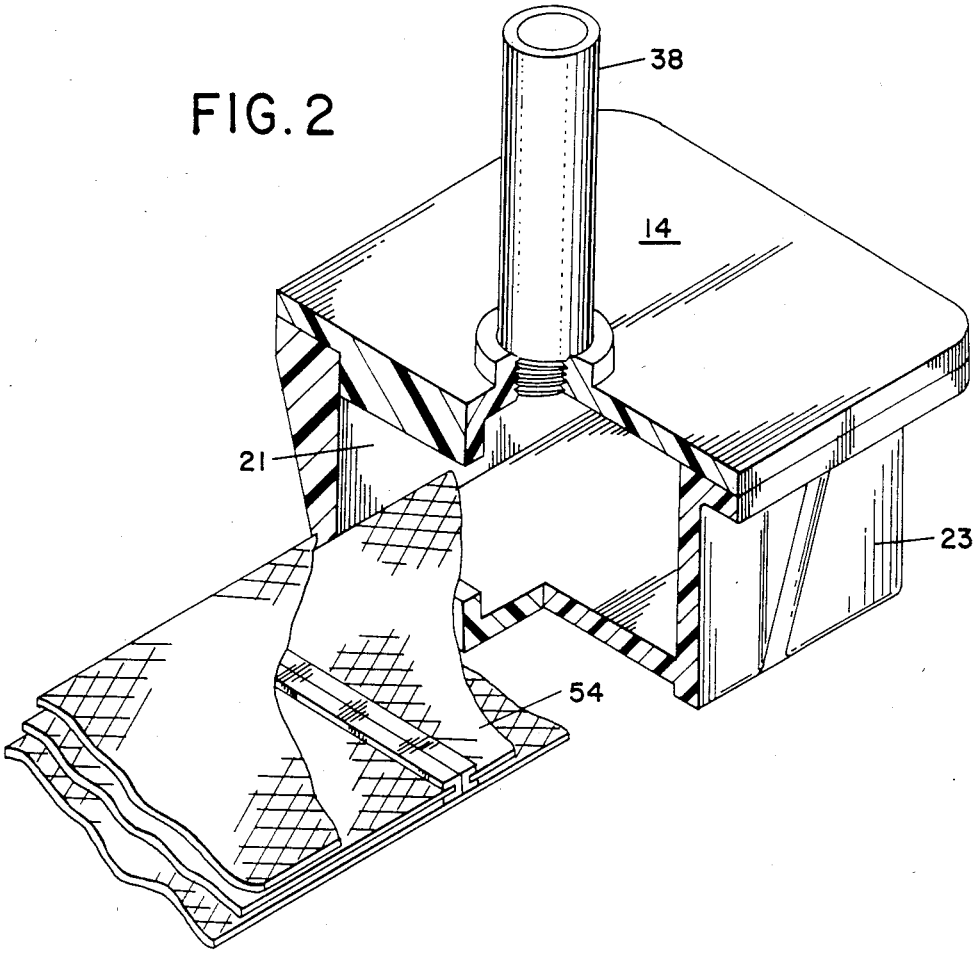
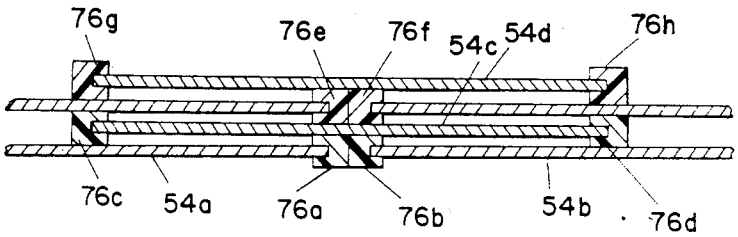
FIG. 3
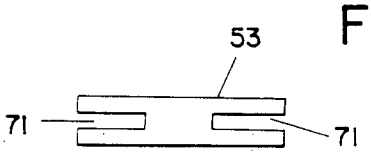
FIG. 5
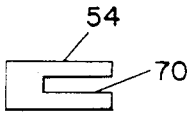
FIG. 4

BIPOLAR ELECTROLYZER HAVING FIXEDLY SPACED APART ELECTRODES

BACKGROUND OF THE INVENTION

The present invention relates to an improved bipolar electrolyzer adapted for the use in the production of oxyhalogen compounds such as sodium chlorate by electrolysis of an alkali metal halide such as sodium chloride. More specifically the instant invention concerns a bipolar electrolyzer which is characterized by its low voltage drop, ease of maintenance and relative low cost.

Multielectrode electrolytic cells including bipolar electrodes have been used for the production of oxyhalogen compounds due to the fact that this type of cell is compact and does not require electric current leads and exposed metallic members connecting the bus bars to the intermediate electrodes. Electrical connections need be made only to the terminal electrodes.

In the production of sodium chlorate, sodium chloride in an aqueous solution is disassociated by electrolytic action. In the absence of an anode to cathode separator, or diaphragm, these disassociated ions immediately recombine by chemical action to form sodium hypochlorite and hydrogen gas shown by the following equations:

$$2NaCl + 2H_2O \xrightarrow{e} Cl_2 + 2NaOH + H_2$$

$$Cl_2 + 2NaOH \longrightarrow NaOCl + NaCl + H_2O$$

By a much slower process the hypochlorite thus formed decomposes to chlorate as shown by the following equation:

$$3NaOCl \rightarrow NaClO_3 + 2NaCl\downarrow$$

In order to maintain good current efficiency and optimum reaction conditions the electrolyzer is generally positioned within a reaction tank. To assure optimum operating conditions the electrolyte should circulate rapidly and turbulently through the cell to insure efficient generation of hypochlorite and then circulate between the reaction tank and electrolytic cell, at a rate which provides sufficient residence time for conversion of the hypochlorite to chlorate in the reaction tank. The generation of hydrogen gas at each cathode surface in the electrolytic cell provides the driving force to circulate the electrolyte through the individual cell compartments in a parallel flow pattern.

Considerable heat is generated during the electrolysis in the cell units and to insure proficient performance of the cells and for stability of the materials of construction it is necessary to provide for removal of the generated heat. Cooling coils are generally immersed in the reaction or holding tank to maintain suitable operating temperatures.

When suitable chemical and pH conditions are maintained in the operation of electrolytic cells, current efficiency is dependent primarily on the rate of flow of the electrolyte solution through the cell units, the current leakage loss and holding tank residence time.

To minimize current leakage each bipolar electrode is provided with an electrical insulating spacer on each end. These non-conducting spacers have a horizontal groove or channel so that they may be slipped over the end of the electrode and thus held in place. When these electrodes are stacked in an overlaying vertical stack, the insulating spacers which are located at the midpoint of alternate electrodes provide for both spacing of anode and cathode and for the isolation of each cell compartment. Each of these cell compartments which are arrayed in series electrically may house as many horizontally arrayed bipolar electrodes in the vertical stack as is necessary to achieve the capacity desired. Openings are provided in the top and bottom of the cell box in sufficient number for each compartment to allow for inlet and outlet flow of electrolyte.

U.S. Pat. No. 3,819,503 describes a bipolar cell which has improved operating characteristics. However, this cell design utilizes bipolar electrode assemblies which are formed by bolting together stacks of monopolar electrodes to form bipolar electrodes. In this type of arrangement, it is difficult to maintain constant spacing between electrodes. Cost is greater and voltage drop, and thus power consumption; is higher.

Accordingly, it is an object of the present invention to provide an improved bipolar electrolytic cell configuration wherein a bipolar electrode assembly is employed which is not formed of monopolar electrodes bolted together and which has associated therewith a means for maintaining the spacing between individual electrodes in the assembly.

Another object of the invention is to provide an improved means of mounting the monopolar terminal electrodes in the terminal compartments of the electrolytic cell.

These and other objects of the invention will be apparant to those skilled in the art from a reading of the following specification and claims.

BRIEF DESCRIPTION OF THE DRAWINGS

The invention may take physical form in certain parts and arrangement of parts, the preferred embodiment of which will be described in detail in the specification and illustrated in the accompanying drawings which form a part hereof and wherein:

FIG. 2 is an isometrical drawing illustrating certain features of the bipolar electrolytic cell of the present invention;

FIG. 3 is a diagrammatical side elevational view, in cross section, of a bipolar electrode sub-assembly which is formed by assemblying in the cell, a plurality of bipolar electrodes with spacer members at each end and offsetting longitudinally alternate electrodes;

FIG. 4 is a side elevational view, in cross section, of a spacer member used in the practice of the instant invention; and, FIG. 5 is a side elevational view, in cross section, of an alternate embodiment of a spacer element which can be used in the practice of the instant invention.

DETAILED DESCRIPTION OF THE PREFERRED EMBODIMENT OF THE INVENTION

Figure 1:
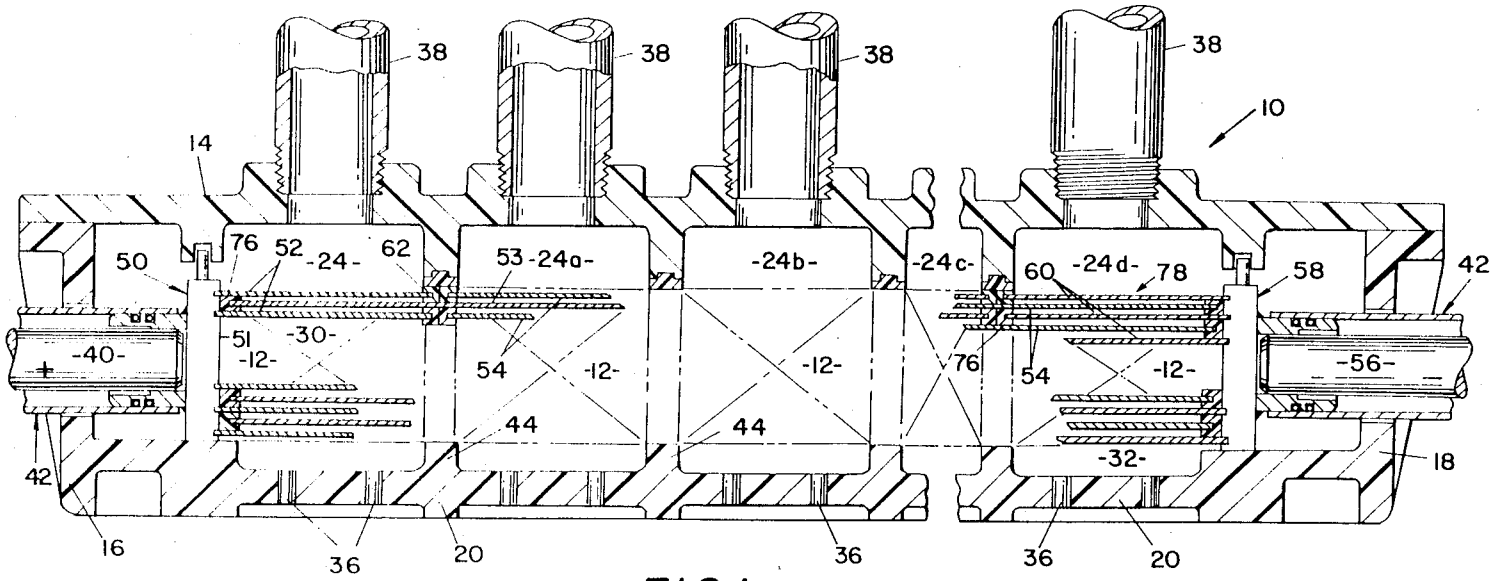
FIG. 1 is a cross-sectional view, partially broken away, of a bipolar electrolytic cell constructed in accordance with the present invention.

Referring now to the drawings wherein the showings are for the purpose of illustrating the preferred embodiment of the invention only and not for the purpose of limiting the same, the FIGURES show a multipolar electrolyzer generally designated by the numeral 10. Various components used in the practice of the instant invention are also illustrated.

Referring in detail to the drawings, and in particular FIGS. 1 and 2, there is shown an electrolyzer 10 having therein an electrolyzer chamber 12. The electrolyzer 10 has a cover 14, opposed ends 16, 18, bottom 20 and opposed sidewalls 21, 23. The assembly of electrodes and separators with electrolyzer chamber 12 form a plurality of individual cell compartments, with compartments 24, 24*a*, 24*b*, 24*c* and 24*d* being shown in FIG. 1. A plurality of ports 36 are provided in the bottom 20 of the electrolyzer 10 for permitting electrolyte to enter into the individual cell compartments for the purpose of being electrolyzed therein. The cover 14 of the electrolyzer 10 is provided with a plurality of circulation ducts 38 to permit electrolyte and gas to flow out of the individual cell compartments. Anodic current is introduced to the electrolyte cell by means of bus 40. The bus bar is provided with a suitable bus protector 42. An anode current distributor 50 is provided in electrical contact with bus 40. The cell also includes a cathode current distributor 58 which is a mirror image of anode distributor 50. Likewise, a suitable bus 56 is in electrical contact with the cathode current distributor 58. A bus protector 42 encloses bus member 56. The anode current distributor forms a wall of one terminal compartment with the cathode current distributor forming a wall in the other terminal compartment. Electrical current is passed through the electrolytic cell by means of bus members 40, 56. Since the means of passing current through an electrical cell of this type are well known, they will not be discussed herein in further detail.

The cathode current distributor is provided with a plurality of monopolar cathode electrodes 60 bonded thereto. The anode current distributor is provided with a plurality of monopolar dimensionally stable anodes 52 bonded thereto. Each free end on both anode and cathode electrodes is provided with an insulating spacer 76 installed thereon. As shown in detail in FIG. 3, starting at the bottom of the electrolyzer, bipolar electrodes 54 are placed end to end filling the space between the electrode attached to the anode distributor and the electrode attached to the cathode distributor. Each end of each bipolar electrode has installed thereon an insulating spacer 76 thereby insulating each electrode from the other. This bottom layer of electrodes is supported by vertical ribs 44 on the electrolyzer bottom. The next layer of electrodes consisting of a plurality of bipolar electrodes each with an insulating spacer 76 on each end is laid on top of the first layer starting between the electrodes bonded to the anode and cathode distributor. Since this layer of electrodes is inserted between the electrodes bonded to the distributors, this layer requires one more bipolar electrode than does the bottom most layer. Since the monopolar electrodes bonded to the terminal distributors 50 and 58 are one half the length of bipolar electrodes, the ends of the bipolar electrodes equipped with insulating spacers 76 falls in the center of the bipolar electrode below. The next or third layer of electrodes are put in place on top of the second layer filling the gap between the terminal electrodes in exactly the same manner the first layer was installed. The fourth layer of electrodes is the same as the second. The fifth layer of electrodes is the same as the first and third. Thus, the multiple layer of horizontal electrodes is built up into a vertical stack using enough layers to meet the capacity requirement of the electrolyzer. Finally, the electrolyzer cover is installed. Vertical ribs on the underside of the cover which correspond with the vertical ribs on the bottom hold the stack of electrodes firmly in place with each layer of electrodes spaced uniformly from those above and below by the insulating spacers. The insulating spacers as they are stacked one above the other on the underlying electrodes and held tightly in place between the ribs on the bottom of the electrolyzer and on the cover form a partition for each individual cell compartment 24, 24*a*, 24*b* etc. It should be noted that all bipolar electrodes and all insulating spacers are identical each to the other thereby making for minimum and rapid assembly.

FIG. 3 shows, what for the purpose of describing the instant invention, is referred to herein as a bipolar electrode subassembly. In this regard, such a sub-assembly includes spacers 76*a* and 76*b* positioned at the terminal ends of bipolar electrodes 54*a* and 54*b*, respectively. Stacked on top of spacers 76*a* and 76*b*, is a bipolar electrode 54*c*. Affixed to the terminal ends of electrode 54*c* are spacer 76*c* and 76*d*. Positioned on top of electrode 54*c* are spacers 76*e* and 76*f*. On top of spacers 76*e* and 76*f* is a bipolar electrode 54*d* having spacers 76*g* and 76*h* on the terminal ends thereof. The bipolar sub-assembly is formed in place as discussed hereinbefore. Obviously, the number of bipolar electrodes used and the vertical height of the stacked electrodes can be varied as desired.

An electrically insulating member suitable for use in the practice of the invention is shown in detail in FIG. 4. As is noted, the electrically insulating spacer member 54 is of a generally rectangular cross-sectional shape having in one edge thereof a channel 70. This channel is sized to receive rectangularly shaped dimensionally stable bipolar electrodes as is shown in FIG. 2. FIG. 5 is directed to another embodiment of an electrically insulating spacer member which can be used in the practice of the instant invention. The device illustrated in FIG. 5 is a double channel spacer member 53 having a channel 71 in each edge thereof which is sized to receive bipolar electrodes of the type used herein.

In the embodiment of the invention illustrated in the drawings, the electrodes are all horizontally disposed in the electrolytic cell. And, with the exception of the monopolar anodes and cathodes, all the electrodes in the cell are all interleaved foraminous bipolar electrodes 54. The foraminous bipolar electrodes are constructed and arranged such that the various assemblies of bipolar electrodes in cell compartments 24, 24*a*, 24*b*, 24*c* and 24*d* are horizontally interposed between the terminal electrodes assembly compartments. Obviously, if desired, the electrolyzer can be constructed with additional cell compartments and with additional electrodes in each cell compartment. The bipolar electrodes are arranged so that one portion of the electrode of one polarity is positioned in one compartment and the other portion of opposite polarity extends into an adjacent compartment in a face-to-face relationship. In this manner, the anode and cathode portions of said bipolar electrodes of the assembly alternate in sequence both in vertical and horizontal directions throughout the cell. As is noted, the bipolar electrodes are stacked in an alternating fashion one on top of the other and separated by a plurality of electrically insulating spacer members 76. In the terminal anode assembly of compartment 24, the cathode portion of each bipolar electrode in the compartment is positioned in substantially face-to-face relation to each anode. The dimensionally stable anode portion of each bipolar electrode included in the terminal cathode assembly compartment is arranged in substantially face-to-face closely spaced relation to each cathode. All the remaining electrodes are interleaved foraminous bipolar electrodes extending into two adjacent cell compartments. The bipolar electrodes are mounted in the same manner as described hereinbefore. The bus bars in each terminal compartment are required to be electrically conductive and any conductive metal may be used. Generally a valve metal, preferably titanium is used. The anodic current distributor 50 has extending therefrom horizontally a plurality of vertically spaced anodes 52. These anodes are attached to the surface 51 of current distributor 50. The unattached end of each anode 52 is received in a channel 70 of an electrically insulating spacer member 76. The cathodes 60 fixed to the cathodic current distributor 58 are affixed thereto in a similar manner. The free terminal end of each cathode 60 is received in a channel 70 of an electrically insulating spacer member 76.

The dimensionally stable anode electrodes comprise an electrically conductive substrate with a surface coating thereon of a solid solution of at least one precious metal oxide and at least one valve metal oxide. The electrically conductive substrate may be any metal which is not adversely affected by the cell environment during use and also has the capability, if a breakdown in the surface coating develops, of preventing detrimental reaction of the electrolyte with the substrate. The geometrical configuration of the anodes may vary provided anodes of suitable shape for forming the structural assembly are used. Generally, the substrate is selected from the valve metals including titanium, tantalum, niobium and zirconium. Expanded mesh titanium sheet is preferred at the present time for the horizontally disposed anodes.

In the solid solutions an interstitial atom of a valve metal oxide crystal lattice host structure is replaced with an atom of precious metal. This solid solution structure distinguishes the coating from physical mixtures of the oxides since pure valve metal oxides are, in fact, insulators. Such substitutional solid solutions are electrically conductive, catalytic and electrocatalytic.

In the above-mentioned solid solution host structure the valve metals include titanium, tantalum, niobium and zirconium while the implanted precious metals encompass plantinum, ruthenium, palladium, iridium, rhodium and osmium. Titanium dioxide-ruthenium dioxide solid solutions are preferred at this time. The molar ratio of valve metal to precious metal varies between 0.2–5:1, approximately 2:1 being presently preferred.

If desired, the solid solutions may be modified by the addition of other components which may either enter into the solid solution itself or admix with same to attain a desired result. For instance, it is known that a portion of the precious metal oxide, up to 50 percent, may be replaced with tin dioxide without substantial detrimental effect on the overvoltage. Likewise, the defect solid solution may be modified by the addition of cobalt compounds particularly cobalt titanate. Other partial substitutions and additions are encompassed. Another type of dimensionally stable anode coating which may be used with good results in the practice of this invention consists of mixtures of chemically and mechanically inert organic polymers and solid solutions of valve metal and precious metal oxides as at least a partial-coating on the electrically conductive substrate. Particularly useful materials in such anode coatings are the above-described solid solutions in admixture with fluorocarbon polymers such as polyvinyl fluoride, polyvinylidene fluoride and the like coated on at least part of the surface of an electrically conductive substrate consisting of the above-described valve metals and other suitable metals.

One other type of dimensionally stable anode capable of satisfactory use in this invention consists of a valve metal substrate bearing a coating of precious metals or precious metal alloys, particularly platinum and alloys thereof on at least part of its surface.

The above-mentioned preferred solid solution coatings are described in more detail in British Patent No. 1,195,871.

The monopolar anodes and cathodes may be any metal capable of sustaining the corrosive cell conditions and a useful metal is generally selected from the group consisting of stainless steel, nickel, titanium, steel, lead and platinum. In most cases the cathodes may be coated with the solid solutions above described for coating the dimensionally stable anodes.

The cell is useful for the manufacture of alkali metal chlorate by a process which comprises the steps of introducing an aqueous alkali metal halide solution into the cell compartments, imposing an electrical potential across the electrodes to electrolyze the alkali metal halide solution, the temperature of the solution being maintained at about 60° C. to about 80° C. and the pH of the solution being maintained at about 6.0 to about 7.5 during electrolysis, and recovering alkali metal chlorate from the electrolyzed solution. The electrolyzer is initially positioned within a surrounding tank in such manner that the ports through the bottom of the electrolyzer for each compartment are spaced from the bottom of the enclosing tank to permit entrance of the solution and the conduits extending from the cover are below the top edges of the sidewalls of the tank. The halide solution is introduced into the surrounding tank to completely cover the electrolyzer including the conduits carried by the cover. A decomposition potential is then imposed across the cells for electrolysis. During electrolysis gases generated at the electrode surfaces lower the density of the solution within the cells.

A "chimney effect" causes the solution in the tank surrounding the electrolyzer to enter the openings in the bottom and flow rapidly upwardly through each compartment assembly where electrolysis occurs and to exist rapidly upwardly through the open-ended vertical conduit in and extending from the cover above each compartment into the tank surrounding the cell. A cooling coil is preferably arranged within the enclosure tank for temperature control. Typically this cooling coil is positioned horizonatlly below the electrolyzer so that the circulating electrolyte passes through the coils before entering the electrolyzer, but any other suitable location in the path of circulation would be acceptable.

Since the unit compartments or cells are completely enclosed with the exception of open conduits carried by the cover and ports in the bottom, the solution flows very rapidly and vigorously through the entire electrode assembly. In this manner sodium hypochlorite is rapidly produced electrochemically with very limited simultaneous production of sodium chlorate. After the solution exits from the cell sufficient residence time is provided in the surrounding tank for chemical conversion of the hypochlorite to chlorate by the large volume of solution contained in the tank and time lapse during circulation through the tank and reentry to the cell. The design of the cell thus enables production of alkali metal chlorate in the most efficient manner since the major amount of chlorate is produced chemically rather than by the more expensive electrochemical reaction.

While this invention has been described by a number of specific embodiments, it is obvious there are other modifications which can be made without departing from the spirit and scope of the invention as set forth in the appended claims.

What is claimed is:

1. In a multielectrode bipolar electrolytic cell having a generally rectangular floor with vertical side walls extending up from the periphery thereof and a closure lid covering the top of said walls and substantially parallel to said floor, an electrical current distributor insulatingly mounted just inside each end wall of said cell and in electrical connection with a bus leading from external D.C. power source, a plurality of substantially horizontally disposed, foraminous dimensionally stable anodes assembled in electrical contact with the current distributor which is in electrical connection with the positive bus and vertically spaced apart from each other so as to permit cathodes to be interleaved therewith, a plurality of substantially horizontally disposed, foraminous cathodes similar in number to said anodes assembled in electrical contact with the current distributor which is in electrical connection with the negative bus and vertically spaced apart from each other so as to permit anodes to be interleaved therewith, and a plurality of substantially horizontally disposed bipolar electrode sub-assemblies intermediate said current distributors, said sub-assemblies including a series of vertically spaced apart bipolar electrodes mounted so that their cathode portions are interleaved with the dimensionally stable anodes which are in electrical contact with the positive current distributor and another series of such bipolar electrodes mounted so that their anode portions are interleaved with the cathodes that are in electrical contact with the negative current distributor, the improvement which comprises said sub-assemblies being stably mounted without the use of fixed partitions or threaded fasteners by use of a flat-sided, electrically insulating spacer bars of uniform thickness each of which has an open horizontal channel cut into at least one edge and into one of which channels is fitted the free end of each of said dimensionally stable anodes and cathodes as well as anode and cathode ends of each of said bipolar electrodes, said sub-assemblies being built up a layer at a time beginning at the bottom of said cell to form electrode stacks in which insulating spacer bars are aligned in substantially vertical rows wherein intervening electrode members alternate therewith to form transverse partitions across the cell dividing it into a series of separate compartments through each of which electrolyte can be circulated upwardly from the bottom.

2. The cell of claim 1 wherein said electrically insulating spacer bars are generally of a one piece construction with a channel on each edge to receive an electrode.

3. The cell of claim 1, wherein each electrically insulating spacer bar that fits over the edge of that portion of a bipolar electrode element that is interleaved with an anode or a cathode that is in electrical contact with one of the current distributors has an open channel cut in only one edge thereof.

* * * * *